United States Patent [19]

Benoit et al.

[11] Patent Number: 4,921,197

[45] **Date of Patent: * May 1, 1990**

[54] BAG HOLDING, DISPENSING, LOADING AND DISCHARGE SYSTEM

[75] Inventors: Gordon L. Benoit, Macedon; Lewis E. Sable, Rochester; Richard A. Wenzel, Pittsford, all of N.Y.

[73] Assignee: Mobil Oil Corporation, New York, N.Y.

[ * ] Notice: The portion of the term of this patent subsequent to Apr. 11, 2006 has been disclaimed.

[21] Appl. No.: 263,291

[22] Filed: Oct. 27, 1988

Related U.S. Application Data

[63] Continuation of Ser. No. 36,599, Apr. 10, 1987, Pat. No. 4,819,898.

[51] Int. Cl.[5] ..... B65B 67/12

[52] U.S. Cl. ..... 248/97; 248/99

[58] Field of Search ..... 248/95, 97, 99, 100, 248/101, 121, 175, 201, 302; 53/390; 141/316, 390, 391; 220/401, 404

[56] References Cited

U.S. PATENT DOCUMENTS

| | | |
|---|---|---|
| 209,749 | 11/1878 | Brown . |
| 769,295 | 9/1904 | Beltz . |
| 1,403,751 | 1/1922 | Edstrom . |
| 1,679,450 | 8/1928 | Thompson . |
| 1,799,537 | 4/1931 | Schindler . |
| 1,971,642 | 8/1934 | Champlin . |
| 2,162,113 | 6/1939 | Noffsinger . |
| 2,648,512 | 8/1953 | Scholin . |
| 3,226,070 | 12/1965 | Kurlander . |
| 3,687,408 | 8/1972 | Lake . |
| 3,737,129 | 6/1973 | Foster . |
| 3,747,298 | 7/1973 | Lieberman . |
| 3,869,065 | 3/1975 | Wang . |
| 4,062,170 | 12/1977 | Orem . |
| 4,175,602 | 11/1979 | Cavalaris et al. . |
| 4,305,558 | 12/1981 | Baker . |
| 4,316,353 | 2/1982 | Suominen . |
| 4,407,474 | 10/1983 | Swenson . |
| 4,437,634 | 3/1984 | Hambleton . |
| 4,458,867 | 7/1984 | Malik . |
| 4,461,441 | 7/1984 | Briggs . |
| 4,487,388 | 12/1984 | Provan . |
| 4,538,783 | 9/1985 | Stobbe . |
| 4,623,111 | 11/1986 | Prader . |
| 4,676,284 | 6/1987 | DeCrane . |

FOREIGN PATENT DOCUMENTS

| | | |
|---|---|---|
| 227176 | 3/1972 | Austria . |
| 1138851 | 4/1983 | Canada . |
| 155589 | 8/1956 | Sweden . |

*Primary Examiner*—Alvin C. Chin-Shue
*Assistant Examiner*—Robert A. Olson
*Attorney, Agent, or Firm*—Alexander J. McKillop; Charles J. Speciale

[57] ABSTRACT

The present invention includes a new bag packaging system for open mouth bags made of flexible material, preferably a thermoplastic side gusseted bag with handles integrally formed therein, which provides a complete bag packing environment and includes a base member, a bag supply means secured to the base member, and bag-engaging elements supported vertically above the base member opposite the bag supply means at a distance and height for expanding the mouth of the bag and to secure the bag against collapse while loading. Furthermore, the present invention provides a means for continuously presenting a bag-detaching point to the packer which facilitates removal of the bags from the bag supply means and optimizes the loading area. A further feature of the present invention includes minimal structure which could hinder easy removal of the loaded bag from the system. The present invention also provides a total packaging environment wherein bags of several sizes can be simultaneously provided to the packer for selection.

3 Claims, 8 Drawing Sheets

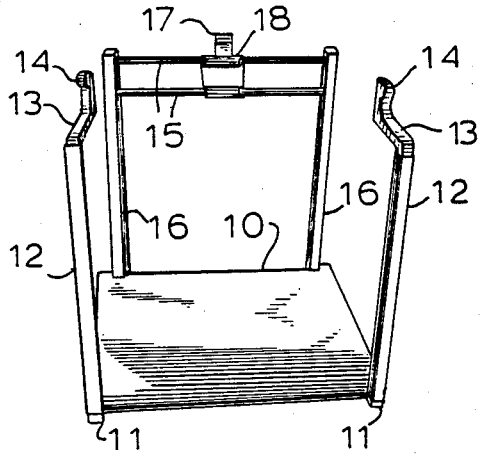
Fig. 1
Fig. 2
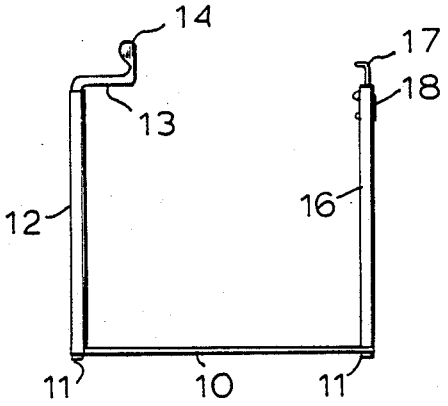
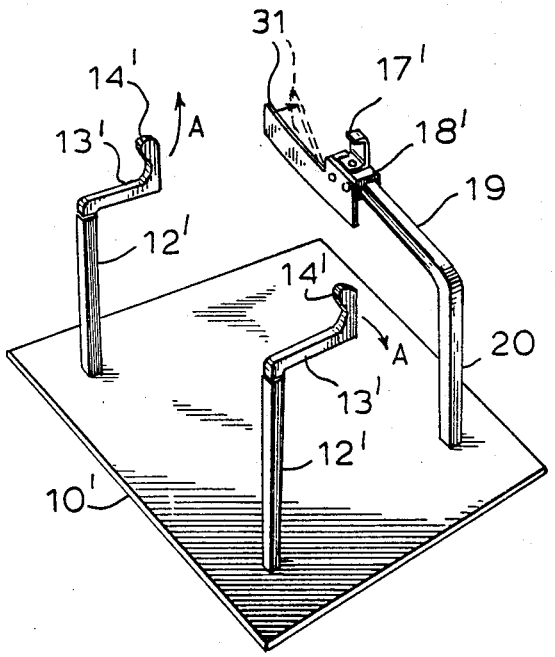
Fig. 3
Fig. 4
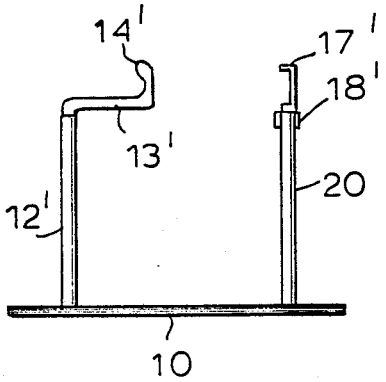

Fig. 5
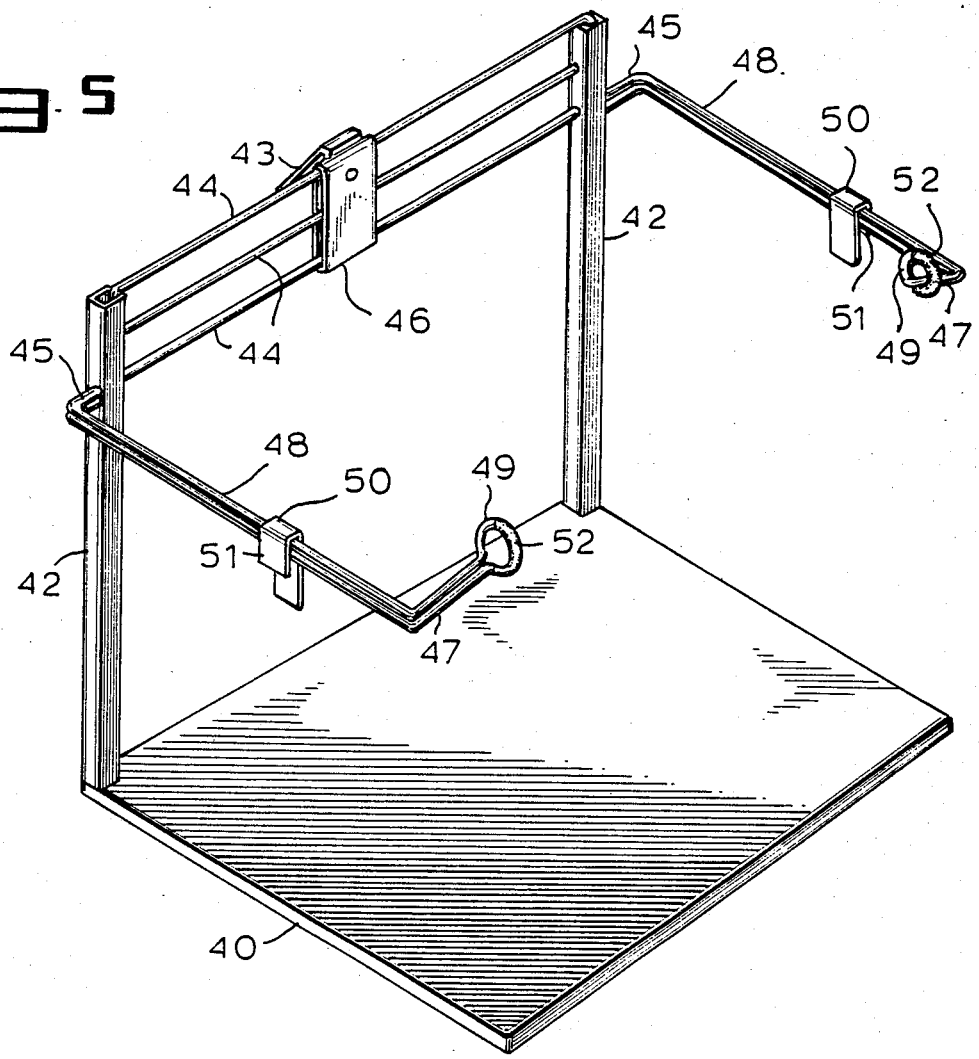
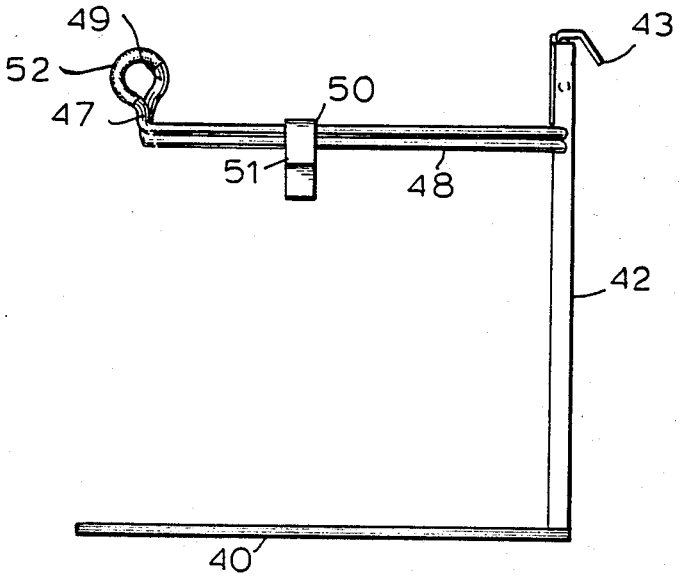
Fig. 6

Fig. 10
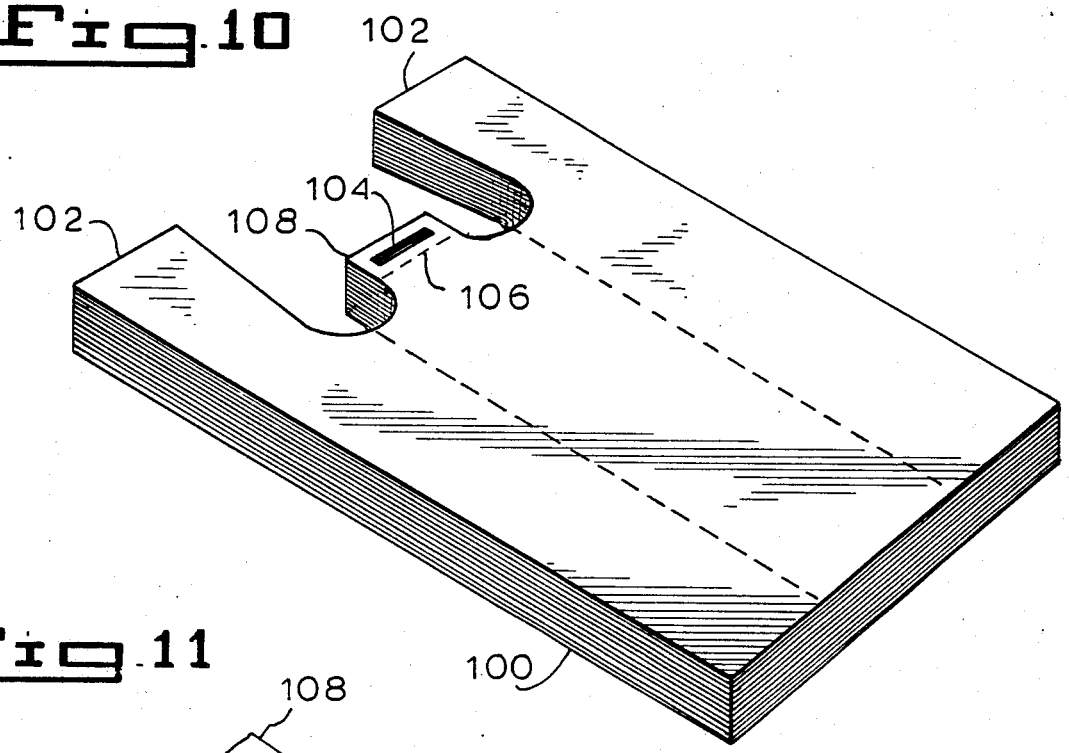
Fig. 11
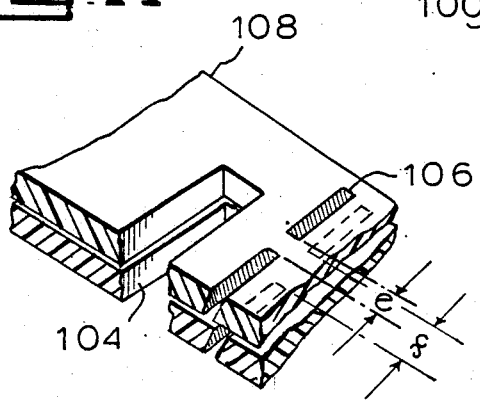
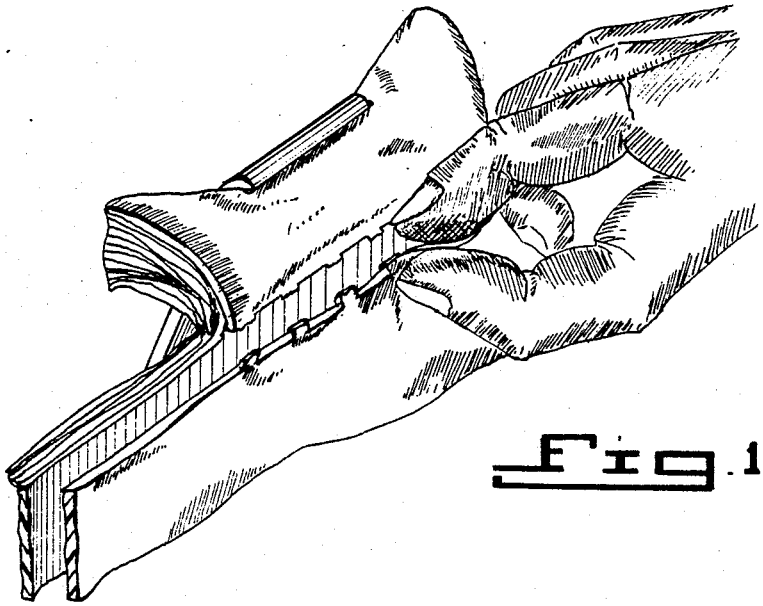
Fig. 12

BAG HOLDING, DISPENSING, LOADING AND DISCHARGE SYSTEM

This is a continuation of copending application Ser. No. 036,599, filed on Apr. 10, 1987 now U.S. Pat. No. 4,819,898.

BACKGROUND OF THE INVENTION

The present invention relates to holders for providing a supply of bags and packing the bags in a fast unencumbered manner. The present invention is particularly useful for flexible thermoplastic film bags having loop handles disposed on opposite sides of the mouth.

Traditionally, merchandise, such as groceries, has been packaged at the check-out counters by the packer retrieving a bag from a stack, opening the bag usually by a quick motion of the arm which causes air to enter the bag and distend it and positioning and loading the bag upright on the counter. After the items are placed in the bag, it must be somewhat carefully transferred to the customer in a motion which permits the customer to put their arms around the bag at mid- to lower-bag position.

In recent years, merchants have made efforts to overcome the tedious procedure described above by packaging items in plastic bags. However, these plastic bags are limp and, thus, create problems in both loading and carrying.

The plastic industry has attempted to overcome these deficiencies by, first of all, providing handles on plastic bags adjacent to the mouth of the bag. This has helped to alleviate the carrying problem, but the loading operation is still a problem since flexible plastic bags do not provide a structured receptacle for insertion of the items to be loaded.

Elaborate devices have been used to open and support empty bags, such as blowers which fill the bag with air and vacuum systems which hold the walls of the bag apart and upright, but these systems can be expensive, require substantial redesign and modifications of check-out counters and are subject to mechanical breakdown in heavy use.

Although semi-rigid plastic films, such as vinyl, high density polyethylene and high modulus laminar structures formed therefrom, are available and could be used to construct bags which are self-supporting, the cost of such material is far in excess of acceptable bag production commodities and is, therefore, an economically unattractive solution.

Lieberman U.S. Pat. No. 3,747,298 discloses a wicket bag dispensing unit which includes a vertical wall having a gate formed therethrough and bag opening and expanding means attached to the front of the wall. A stack of bags are secured to the back of the vertical wall with the front side of the first bag abutting the back side of the vertical wall. The Lieberman unit requires that each bag be provided with a lip extending transversely across the width of the bag which is formed by folding down the front side of each bag and heat sealing either end of the fold to the front side of the bag. Lieberman provides hook arms as opening and expanding means, having penetrable ends which would easily disrupt the structural integrity of the side of the bag under even rather mild load conditions. Furthermore, the wicket mounting scheme of Lieberman causes the front side of each of the bags to be somewhat inaccessible for grasping and opening.

Hambleton U.S. Pat. No. 4,437,634 discloses a device to hold open for loading a limp plastic bag having a pair of integral handles and a body portion terminating in a base. A pair of oppositely-disposed side wall members are upwardly projecting from either side of the base, and each of the wall members are provided with a pair of spaced protuberances affixed to the outer side thereof near the upper edge. Unfortunately, Hambleton makes no provision for holding a supply of bags in position for mounting on the device. Furthermore, the Hambleton device is constrained for movement and flexibility by not only the side walls, but also the back wall, and the bag handles must be carefully fitted over the sides and thence the protuberances before packing the bag. Finally, the Lieberman device would require undue care in removing the bag from the holder.

Wang U.S. Pat. No. 3,869,065 shows an apparatus for dispensing and holding carrying bags which includes a frame, a bag magazine for a supply of individual bags and a carrier means. Also a bag pick-up and holding means is supported reciprocably on the carrier means in a vicinity directly opposite the magazine rail means. The pickup means is operative to move substantially horizontally from an initial position to the foremost bag stored in the magazine and engage serrations or cut-outs in the outermost bag panel only. When the carrier means including the pick-up means returns to the initial position a bag is dispensed and held in open position suspended between the magazine rail means and the pick-up means. Wang, however, requires rather extensive modification of existing check-out lines and also necessitates careful unthreading for removal of the bags from the pick-up and holding means.

Suominen U.S. Pat. No. 4,316,353 depicts a bag support and dispensing apparatus having support shafts for supporting a plurality of stacked bags by engaging each bag in the stack through aligned apertures in the front and rear walls of the bag. Pivotally mounted, extending hangers are positioned opposite the support shafts to engage a front wall of the top-most bag in the stack through an associated aperture in the front wall, so that the bag is supported in an open loading position by the support shaft at the rear wall and the extending hanger at the front wall. Suominen provides only two-point support for the bag and requires dexterous manual effort by the packer to remove the loaded bag.

Baker U.S. Pat. No. 4,305,558 discloses a system for supporting a bundle of bags for access and loading adjacent a checkout area of a store which includes a first support member adapted to support a bundle of bags. The first support member includes an elongated substantially horizontally disposed member mounted beneath the countertop of a checkout area so that a substantial portion of the bundle of bags are out of view. A second support member adapted to support one handle of a bag is mounted at a spaced distance apart from the first support member so that the width of a bag in its open condition fits over the support members. Baker, like Suominen, provides only a two-point bag support system which requires care to unthread the apertures from the support members. Furthermore, Baker's system cannot be accommodated by all checkout areas because of the distance between counters.

U.S. Pat. No. 4,062,170 provides an effective holder for loading plastic bags having handle loops. In this patent, a user removes the topmost bag from a stack of bags supported at the rear of the holder, places each of the handle loops of the bag on a respective one of spaced arm portion tabs, loads the bag, and removes the loaded bag from the holder by lifting the handle loops from the tabs. Provan U.S. Pat. No. 4,487,388 discloses a wire holder for facilitating loading of plastic bags which have integrally-forming carrying handles.

There is also commercially available a bag dispensing system wherein a supply of bags suspended from a support is provided with tab members on each wall of each bag, such tabs having an aperture for threaded engagement with support rods extending horizontally from the support. The bags can be opened by passing the tabs of the front wall forward over the rod to the desired opening, and then packed and removed. This system requires extra manufacturing steps and suffers several drawbacks relating to strength of the tab members and the difficulties associated with the threaded engagement with the rod supports.

However, in the above systems, as well as others related to providing a supply of and packing of plastic bags, the structure and operation of the bag loading scheme is dependent upon looping the handle over bag-securing protrusions which also expand the bag for loading. This procedure presents several problems which directly affect the ease and efficiency of the loading operation.

First of all, the packer is required to locate the handle and to carefully secure one end of the handle loop to one end of the protrusion before threading the protrusion through the handle. This requires the attention of the packer and time to insure that the bag handles are secure. Obviously removal of the bag is also unnecessarily difficult, since each handle must be carefully urged back over the engaging protrusion under loaded condition.

Furthermore, handle-expanding/handle-engaging elements require the system to have bag support structure on either side, thus prohibiting or severely encumbering side removal of a loaded bag.

Thus, it is an object of the present invention to provide a system, which can be used with flexible, thermoplastic bags, especially those having integral loop handles with gusseted sides whereby the handle is formed of a double film, for holding, dispensing, loading, and discharging the loaded bags in a quick, unencumbered manner. An especially effective use of the present invention is in combination with the front-side-free thermoplastic bags such as those disclosed and claimed in commonly-assigned co-pending U.S. application Ser. No. 925,752 filed Oct. 30, 1986, the contents of which are incorporated herein by reference.

Another object of the present invention is to provide a bag loading environment in which a packer can avail himself or herself of several bags located in the same system.

A further object of the present invention is to provide enhanced bag dispensing capabilities in those systems employing single bag release from stacks of bags with a stack fixing opening therethrough.

SUMMARY OF THE INVENTION

The present invention includes several aspects of a bag packaging system for open mouth bags made of material sufficiently flexible to enable folding of the mouth of the bag without destroying the integrity thereof. The present invention is particularly designed to enhance packing by use of thermoplastic, gusseted bags with integral handles formed with double film thickness resulting from the gusseting. In one aspect the present invention is an apparatus which includes a base member for supporting vertically extending elements, a bag supply support means secured to the base member for receipt of a supply of bags and which has a height suitable for dispensing the bags. Also bag-engaging elements are supported vertically above the base member opposite the bag supply support means at a distance and height for expanding the mouth of the bag when the mouth is engaged therewith sufficiently to permit loading of the bag and simultaneously securing the bag against collapse and disengagment therefrom under loaded conditions. The bag-engaging element has a size and a shape for securing the bag without tearing under loaded conditions when the mouth of the bag has been folded over the elements, and for unencumbered removal of the mouth of the bag after loading the bag.

In one embodiment, the bag-engaging elements can be supported on vertically oriented legs fixed to the base member opposite the bag supply support means. In this configuration, preferably the bag-engaging elements include extension members having a first end fixed to the legs and a second end having bag-contacting portions. In this way the legs can be fixed to the base member beyond the distance for expanding and securing the bag, and the extension members can be extended from the legs toward the bag supply support means to provide the body contacting portion at the required distance for expanding and securing the bag. Consequently, structure is removed from the work area of the system so that the bags can be expanded, loaded and removed with greater facility.

The bag supply support means in one of its simplest manifestations, can include one post fixed to the base member and one substantially horizontal bar element secured to the post over which a stack of bags can be supported. Alternatively, there can be two posts fixed to the base, with the bar element connected to the upper ends of both posts thereby interconnecting the posts. Another bar element can also be included to extend between the posts. In this way bags draped over the top bar can be secured at least in the back portion thereof threadedly around the second parallel bar member.

Also in the preferred embodiment, there can be included a first bag holding means which fixes the stack of bags for dispensing and loading. When a stack of bags are provided with an opening at the top portion thereof adjacent the mouth and a detachable connection located below the opening for separation of the bag from the stack, the first holding means can be either an upwardly orientated protrusion or an outwardly oriented tab which is inserted through the opening in the stack of bags.

Preferably the opening through the stack of bags can also be a point of attachment of the bags to the stack by means of fusion resulting from cutting through the stack of bags with a heating element. An additional feature of the present invention is the ability to provide a detachable connection of such a stack of bags so that it is oriented always substantially upwardly when the tab is inserted through the opening in the stack of bags. This can be accomplished by an embodiment wherein the tab is oriented away from the working area rather than directly upwardly. Thus, the detachable connections for all of the bags in the stack are optimally accessible and continuously provide the bags with a detaching torque occasioned by the weight of the bag pulling against the detachable connection which is perched on the top of the stack of bags.

The present invention also contemplates having arm portions extending from the posts at a distance and height for expanding and securing the bags. These arm portions can be formed to provide maximum circumference for work space in the system by forming them to surround the base element rather than projecting directly forward from the posts. In this case, the bag-engaging elements also include a spanning element attached to the arm at the end thereof, which reaches to and supports a bag contacting portion at the required distance for spanning and securing the bag.

A further aspect of the present invention is the inclusion of auxiliary bag holding means which fixes other stacks of bags simultaneously for dispensing and loading. In one manifestation, the auxiliary bag holding means can be attached to the arm portions extending from the post so that a packer can be provided with as many as, for example, three stacks of bags for packing. As indicated before with respect to the first bag supply means the auxiliary holding means can include an upwardly oriented protrusion or a tab oriented away from the work area, both of which can be inserted through an opening in the stack of bags. When the stack of bags includes detachable connections, the same arrangement can be provided on the auxiliary bag holding means as has been provided in the primary bag holding means.

In any event, the bag-engaging element which is used to maintain the bag in an expanded condition and which also supports the bag against collapse when it is loaded, has a shape and orientation such that the perimeter of the mouth of the bag is caused to return against the bag-engaging element under a loaded condition. This occurs when the mouth of the bag has been folded over the bag-engaging element to form a cuff thereover and the shape and orientation of the bag-engaging element actually cams the mouth perimeter of the bag into the bag securing engagement under load conditions. This feature can be enhanced by providing a surface with a non-slip coefficient of friction between the bag-engaging element and a plastic bag. Such a shape can include a hook, sphere, a loop, or an upwardly diverging surface. Other shapes can be included just so long as they do not tend to tear or rip the bag under loaded conditions.

In one embodiment, the bag-engaging elements are supported in relation to the bag supply means so that when the stack of bags which are welded together and perforated for removal of one side of the bag at a time, the open mouth substantially forms an open trapezoid with handles of the bag oriented outwardly of the mouth when the front side of the bag is folded over the bag-engaging elements and the rear side of the bag remains attached at the perforation. Preferably the ratio of the straight line distance of the perimeter of the trapezoid formed by the point of perforated attachment of the bags and between the bag-engaging elements to the perimeter of the opening of the bag available for folding the bag-engaging element is from about 0.65 to about 1.35, and most preferably from about 0.80 to about 0.98.

In another aspect of the present invention, the system can include the bags themselves, which preferably are thermoplastic, side gusseted bags with integral two-layer handles formed therein. These bags are also preferably stacked one on the other and provided with an aperture therethrough formed by heat cutting through the stack of bags which also fuses the bags in the stack together. And in a most preferred embodiment, the present system includes front-side-free bags such as those disclosed in U.S. application Ser. No. 925,752, filed Oct. 30, 1986, which is incorporated herein by reference.

As a result of the present invention, several very important operational features have been provided to the packer using the packaging system. A total packing environment can be provided in which there are not one but several choices of bags to be used to accommodate the different size of loads being packaged for the consumer.

Another advantage which is realized by the present invention is a structurally unencumbered packing system which provides optimum packing, opening, loading and removing space without the unnecessary additional structure usually required in bag loading systems.

Another advantage of the present system is the ability to optimally orient a detachable connection throughout an entire stack of bags toward the packer regardless of the number of bags which have been removed from the stack, as well as applying a bag-detaching torque continuously to the point of detachment. This is especially effective in the event that the bags are provided with heavy cuts or perforations which permit the easy removal of the front side, and lighter cuts or perforations on the rear wall of the bag so that it remains attached during loading. The present invention is most effective with a bag which is entirely front-side-free and which is attached at the back wall thereof.

For a better understanding of the present invention, together with other and further objects, reference is made to the following description taken in conjunction with the accompanying drawings, and its scope will be pointed out in the appended claims.

BRIEF DESCRIPTION OF THE DRAWINGS

Preferred embodiments of the invention have been chosen for purposes of illustration and description and are shown in the accompanying drawings, wherein:

FIG. 1 is a front perspective view of one embodiment of the present invention in which a loaded bag can be removed from the front or either side of the packaging system;

FIG. 2 is a side elevational view of the embodiment shown in FIG. 1;

FIG. 3 is a right obtuse perspective view of a modification of the embodiment shown in FIG. 1;

FIG. 4 is a side elevational view of the embodiment shown in FIG. 3;

FIG. 5 is a left obtuse perspective view of another embodiment which includes several aspects of the present invention;

FIG. 6 is a side elevational view of the embodiment shown in FIG. 5;

FIG. 10 shows a stack of T-shirt type bags having integral handles formed therewith which can be used in one of the most preferred embodiments of the present invention;

FIG. 11 depicts one style of preferred bag which can be used in the present invention;

FIG. 12 shows actual operation of the type of bags shown in FIG. 11;

DETAILED DESCRIPTION OF THE DRAWINGS

Figure 7:
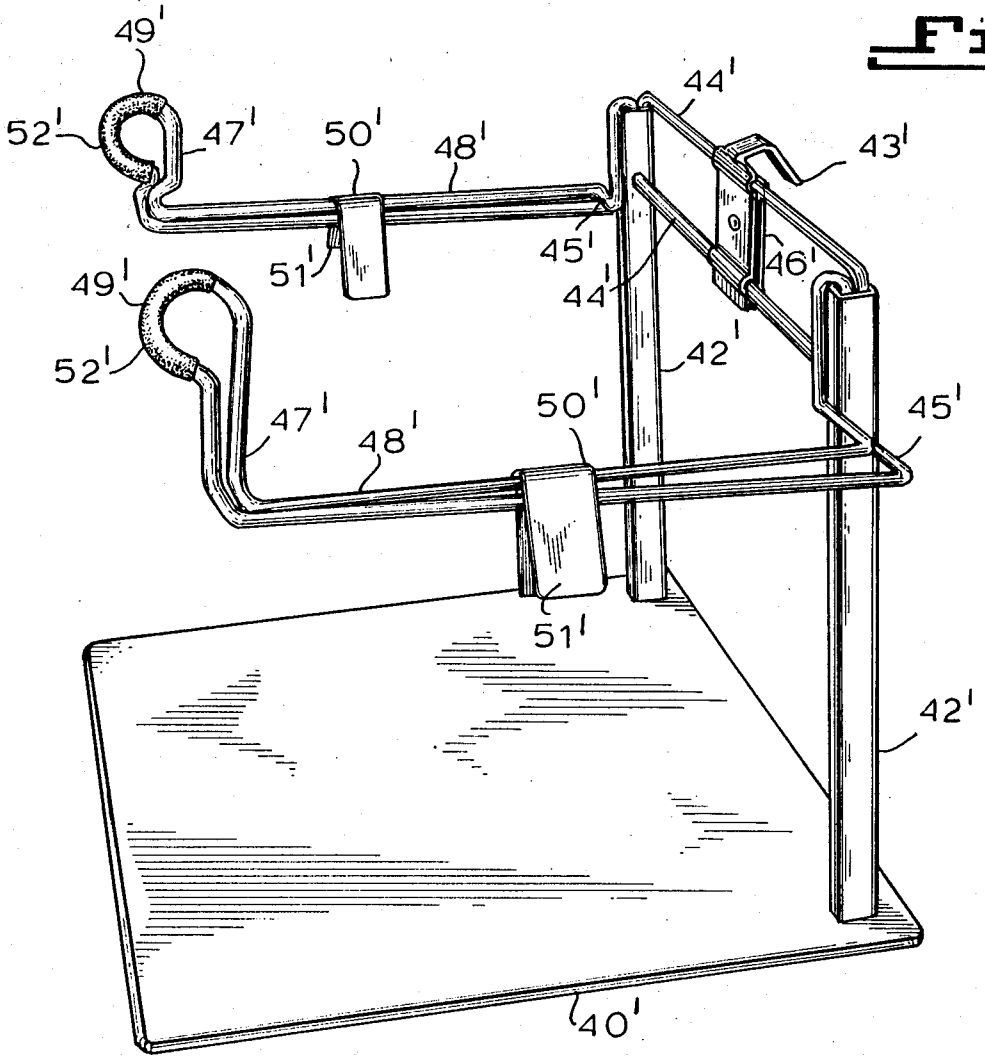
FIG. 7 is a side perspective view of another variation of the embodiment shown in FIGS. 5 and 6.

In the present description, several terms will be continuously used when referring to the invention and in the description of bags which are used in combination therewith. For example, all terms referring to directions on the bag are to be taken relative to the top of the bag where the mouth is located, and the bottom of the bag where the side walls are joined together. Thus, "at the top" refers to a portion which is near or adjacent the mouth of the bag whereas "below" would refer to a position relatively closer to the bottom of the bag. The "front" of the bag is exposed to the user when the bags are stacked in the system in preparation for packaging, while the "back" or "rear" wall of the bag refers to that side of the bag which is farthest away from the packaging area. With respect to the packaging system itself, the environment in which the bags are packaged has a front side facing the working area which is away from the supply of bags hung at the rear of the base, while the sides are considered to be directions laterally left and right from the center line from front to back of the base.

Referring to FIGS. 1 and 2, a structure in accordance with the present invention is shown having a base 10 usually of a size and dimension suitable for placement of the appropriate size bags thereon and for supporting the vertically oriented elements at the appropriate locations. The base 10 can be provided with non-slip feet 11 in the event that the rack is intended for use as a free standing rack, or, in the alternative, the base can be provided with apertures (not shown herein) for securing to a surface. In the embodiment shown in FIGS. 1 and 2, the rack is open on three sides by providing the essential elements of the invention through the use of unconnected supporting elements such as legs 12 in combination with hooks 14. Easy removal of a bag from either side of the rack shown in FIGS. 1 and 2 is further facilitated when the hooks 14 have an extension 13 which permit the legs 12 to be positioned as far as possible from the rear of the rack and the bag supporting structure located thereon.

The bag support structure in FIG. 1 has been shown as consisting of two posts 16 which are vertically-oriented to the desired height for positioning a stack of bags. At the upper end of the post 16 there are interconnecting bars 15 to which a clamp member 18 is secured. The clamp member 18 can be provided with an upwardly oriented projection 17 over which a stack of bags can be fixed for dispensing into a loading position and then removed.

In FIGS. 3 and 4, an alternative embodiment is shown which is similar to the system of FIGS. 1 and 2. Similar elements have been designated with the same numerical designation, but have been given a prime indicators to show that it is a slightly different embodiment. Thus, base 10' is provided with legs 12' having fixed thereon hooks 14' which are extended towards the bag supply means via extensions 13'. The bag supply means, however, is but a single post 20 which has a single support bar 19 extending to support a stack of bags. A clamp member 18' has been provided on the bar 19 along with an upwardly-extending protrusion 17'. Additional features include a flexible bag support 31 which is sufficiently rigid to hold a stack of bags draped thereover, but is easily flexed rearwardly to permit bag removal. It is also contemplated that extensions 13' (13) be provided with a rotatable connection to vertical legs 12' (12) for at least outward rotation to facilitate bag removal, this rotation being illustrated by arrows A in FIG. 3. This feature can also be accompanied by a return feature such as by a cammed surface support, return spring, etc.

In operation, a stack of bags 100, such as those shown in FIG. 10 can be draped over the support bar 15/19 with the handles 102 extending over the backside of the bar away from the base member 10. Preferably the stack of bags 100 have been formed with a through hole 104 and a point of detachment 106 immediately therebelow so that the protrusion 17/17' can be inserted through the opening 104 and the bags removed one at a time from the stack by a detaching force applied to the body of the bag (see FIG. 12). See also FIG. 16 wherein analogous bag structure is shown, with aperture 104' and single perforation 106' as the point of detachment.

In a preferred embodiment, the stack of bags 100 are those types of bags disclosed in U.S. Pat. No. 4,165,832 which is incorporated herein by reference. In that event, the individual bags of the stack 100 are each detachably connected to the tab 108 (108' in FIG. 16) through which the opening 104 has been provided, by means of a front perforation having points of attachment e (see FIG. 11). The individual bags can be bonded together during manufacturing by use of a heated blade element which is raised to a temperature to cause penetration of the blade through the tabs 108 to form the opening 104 and also fuse the peripheral areas of the apertures to bond the bags together into stack 100.

In the most preferred embodiment of the present invention, (see FIG. 11), the individual bags in stack 100 should be formed with a rear perforation having points of attachment f which are greater than point e and strong enough to support the bag in the open position during the loading process while the front part of the bag is engaged with the hooks 14, or in other embodiments shown herein, the bag-engaging element. As a result of this feature, the point of detachment of the bag from the stacks also provides a point for providing the necessary loading opening as well as support for the loading process. It is also contemplated that the front side of the bag can be just minimally retained, or not retained at all, e.g., "front side free."

Figure 16:
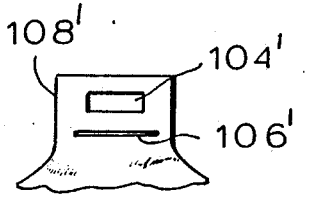
FIG. 16 shows a close up of the bag-holding and detaching features useful in the present invention.

On the other hand, the point of detachment of the bags from the stack need not be perforations, but rather can be a single slit 106' as in FIG. 16 merely providing sufficient strength to keep the bag attached to the stack in the absence of a detaching force.

In operation, protrusion 17 is inserted through the opening 104 with the bodY of the bags in the stack 100 hanging on the side of the support structure facing the base 10. The front side of the bag is detached from the tab 108 and extended forwardly toward hooks 14. At this point, the packer can fold the perimeter of the mouth of the bag over the hooks 14 thereby engaging the continuous body of the bag against the hooks 14. Alternatively, the packer can find the handles in the bag and loop them over the hooks 14.

It has been found that when the hooks 14 are provided at a specific distance from the point of detachment of the bag, the handles may be looped over the hooks 14, but more simply the bag mouth can form the contact point for supporting the bag during packing items in the bag by folding or cuffing the bag mouth over the hooks. In the present invention a shape is provided the hook 14 which causes the perimeter of the mouth of the bag to return against the body of the hook under load conditions. Essentially, the surface of the hook 14 cams the bag material downwardly against the hook surface when the bag is under force.

It is believed that this can be achieved when the ratio of the straight line distance between the point of detachment and the hooks plus the distance between the hooks thereto plus the attachment distance, when compared with the perimeter of the bag made available to the packer for securing is not less than 0.65 and not greater than 1.35. Thus, referring to FIGS. 13 and 14 the distance of the trapezoid a (which is the point of detachment of the bag), b, c and d, the straight line distance between the point of detachment and the hooks, and the distance between the hooks, when compared to the perimeter of the bag opening available to the packer is between 0.65 and 1.35. Moreover when bags having integral handles formed therein are used with this ratio, the handles are made to fall outwardly from the mouth of the bag thereby optimizing loading capability.

Furthermore, it is also preferred that the surface of the bag-engaging member, such as hook 14, have a non-slip, coefficient of friction when in contact with the bag material. Thus, the surface can be provided with additives which provide non-slip surfaces, such as rubber coating, or other friction producing elements to enhance the ability of the surface to retain a bag made of a material such as a polyethylene during loading. As can be seen, whether the bag itself is fitted over the hook or the handles are looped over the hooks 14, the bag, once loaded, can be easily removed since there is no encumbering bag handle-engaging member such as a protrusion expanding the handle to its full extent which must be negotiated during bag removal.

Referring to FIGS. 5 and 6, an additional embodiment of the invention is shown which includes a base 40 having upwardly extending posts 42 supported at the rear portion thereof on which the bag supply structure as well as the support for the bag-engaging elements are provided. Specifically, interconnecting rods 44 extend between the posts 42 on which a clamp 46 is secured with an outwardly extending protrusion 43. Once again, the protrusion 43 is intended to be inserted into an opening in a stack of bags which are hung over the top rod 44 for dispensing the bags into the loading position.

Furthermore, the posts 42 also have secured thereto arms 48 which are formed to provide maximum circumference to the work area for loading the bags. Thus, the portion of the arm connected to the post 42 are provided with surrounding extensions 45 and returns 47 which extend to bag contacting loops 49. In order to provide such arms, it has been found that metal frame wire can be used.

FIGS. 5 and 6 also depict additional bag holding means on the arms 48. The additional bag holding means are shown as fixtures 50 having downwardly oriented tabs 51. These tabs 51 can be inserted through holes or apertures fixed in the top of the bags as previously described. Additionally, the arms 48 can be provided with a pivoting characteristic whereby the arms are free to rotate outwardly away from the work area of the system. As in the previous embodiments the pivotal arms can also have a return feature such as a cam surface, a return spring, etc.

FIG. 7 is an alternative embodiment of the embodiment shown in FIGS. 5 and 6 having similar elements marked with primes rather than using new indicator numerals. Thus, base 40' supports two posts 42' between which interconnecting bar elements 44' are provided having a clamp 46' with a rearwardly oriented tab 43' formed thereon. Arms 48' surround the work area of the packaging system by virtue of extensions 45' and returns 47' on which are fixed loops 49'. It is noted that both the hooks 49 and 49' have been provided with non-slip surface coverings 52, 52' to enhance the ability of the hooks to retain the bags thereon. Each of the arms 48' in FIG. 7 have also been provided with fixtures 50', each having outwardly oriented tabs 51'.

Figure 8A:
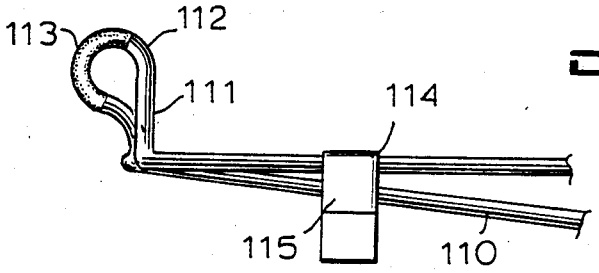
FIGS. 8*a*–8*d* show several alternative embodiments of some aspects of the present invention.

In order to better understand the aspect of the present invention which includes the additional bag supply members, reference is made to FIGS. 8*a* through 8*d*. In particular, FIG. 8*a* is shown as having an arm 110 and a hook element 112 at the end thereof having a non-slip surface 113. Over the arms 110 there is provided a fixture 114 having an outwardly oriented tab 115 for insertion into an aperture through a stack of bags. The hook 112 is also provided with a return 111 by which the arm can be made to provide a greater circumference for a packing work area.

Figure 8B:
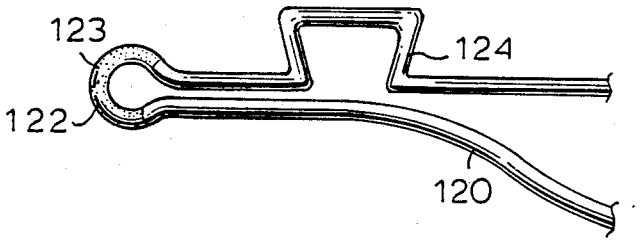

In FIG. 8*b* there is shown an arm 120 having a differently shaped loop 122 (with non-slip surface 123) and a handle-supporting upward protrusion 124. The protrusion 124 is not intended to retain a supply of bags, but rather to give the packer an alternative for slipping the handles of the bags on the first bag holding member over the protrusion 124 rather than necessarily draping the circumference of the mouth over the loop 122. Alternatively, the packer can both cuff the mouth of the bag over loop 122 as well as drape the handles over the protrusions 124 during packing.

Figure 8C:
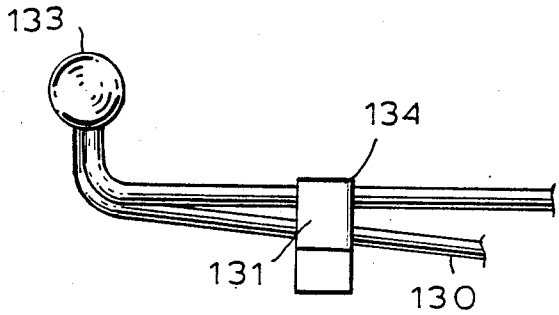

In FIG. 8*c* there are shown arms 130 having a spherical bag retaining portion 133 as well as bag supply fixture 134 with an outward protrusion 131.

Figure 8D:
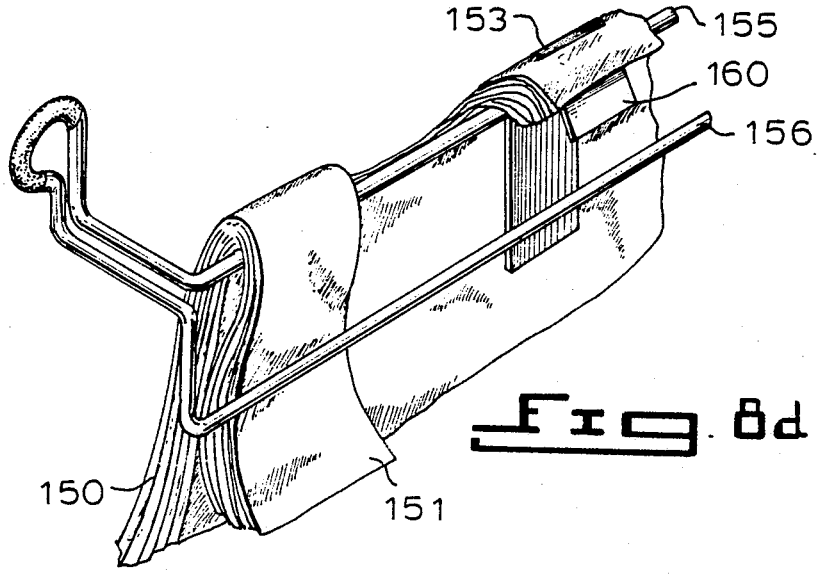

Referring to FIG. 8*d*, in operation a supply of bags 150 can be provided over an arm 155 with the integral handle portions 151 looped under the lower portion 156 of the arm 155. The rearwardly oriented tab 160 can be inserted through an aperture so that the point of detachment of the bag 153 will be upwardly oriented making it accessible to the packer and posing thereon a bag detaching torque on the point of detachment.

Figure 9:
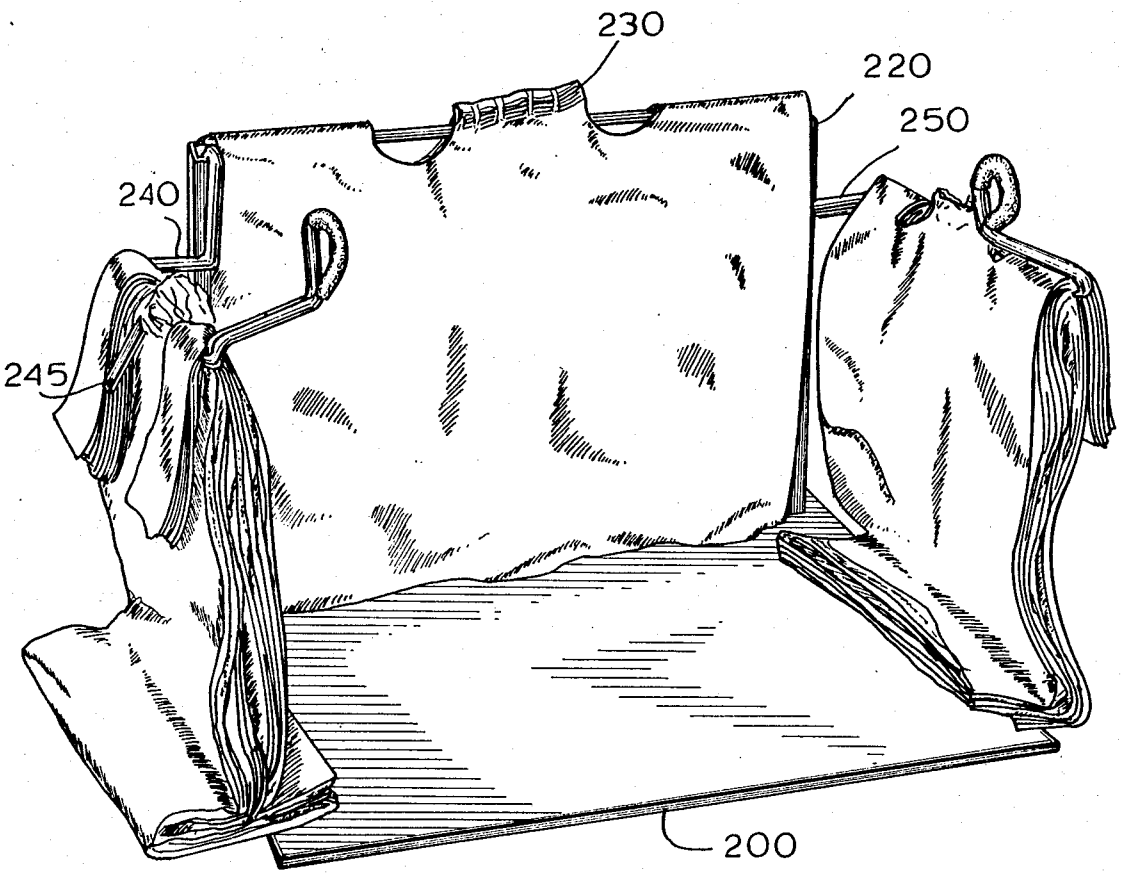
FIG. 9 depicts the present system as it can be configured during operation.

Now, referring to FIG. 9, a total bag packaging environment is shown wherein three different size bags have been provided on the three different bag holding elements in the packaging system. The system therein shows a base 200 provided with a first bag supply means at the rear thereof 220 along with a bag holding element which holds the perforations of the bag supply 230 upwardly for access by the packer. The primary bag supply means 220 has been provided with side arms 240 and 250 on either side thereof on which bag holding elements have also been provided which are oriented away from the work space so that outwardly oriented protrusions 245 and 255 (not seen in the drawing) are utilized, the point of detachment being oriented upwardly for easy access by the packer.

Figure 14:
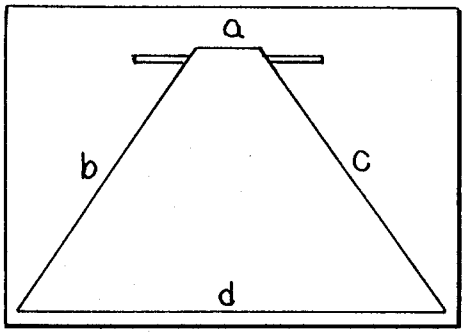
FIG. 14 is a schematic of the dimension of FIG. 13.
Figure 13:
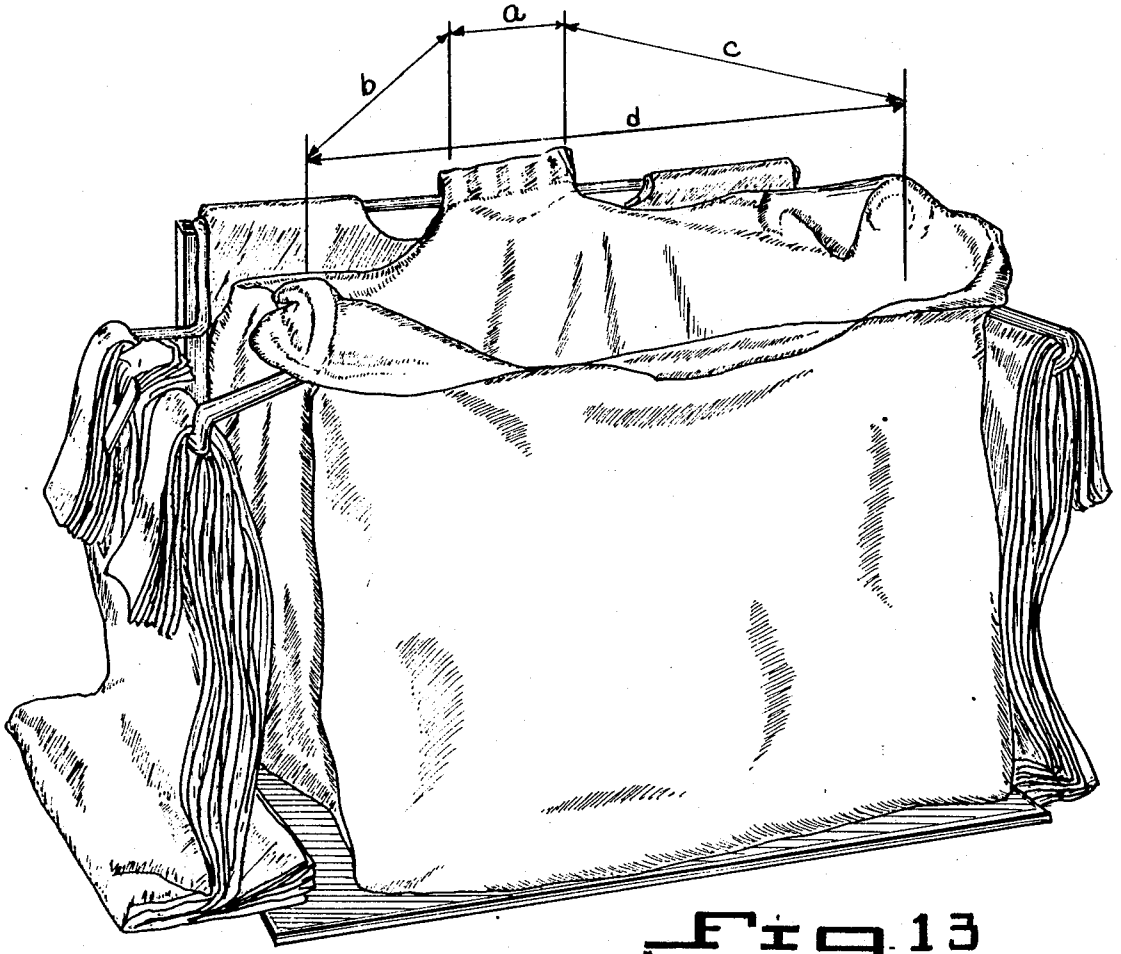
FIG. 13 depicts the relationship of the operative features of the present invention to the dimensions of the bag used therewith.
Figure 15:
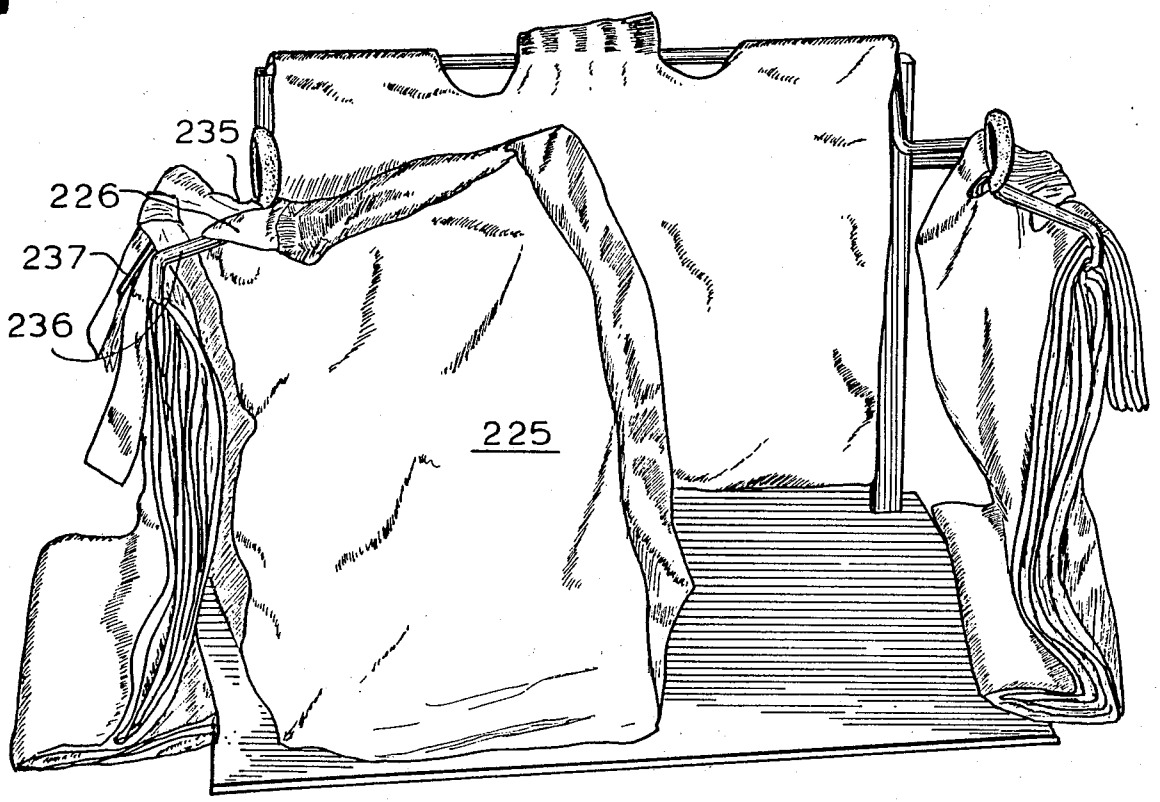
FIG. 15 shows the multiple modes of operation of the invention.

In FIG. 13 there is shown a fully open bag draped or cuffed over the bag-engaging elements. In FIG. 14 there is shown a bag 225 opened from one of the side members 235 with a handle 226 draped over a bag-engaging element 236. It is noted that the side members are not intended to provide a supply of bags which can be draped over opposite bag-engaging elements as with the first bag holder. However, the bag-engaging element 236 provided on the same arm 235 as the respective bag holder 237 can be used to support the bag by the handle thereof when in use.

Thus, while there have been described what are generally believed to be the preferred embodiments of the present invention, others skilled in the art will realize other changes and modifications may be made, and it is intended to claim all such changes and modifications which fall within the true scope of the invention.

We claim:

1. Apparatus for holding a supply of flexible bags and for facilitating the opening and loading of individual bags from the supply, which comprises:

a base member;

means adapted for supporting a supply of bags, the bag supply supporting means being mounted on the base; and means adapted for supporting an individual bag from the supply of bags at portions thereof and for holding the bag in an open, loadable condition, the individual bag supporting means including a pair of support legs mounted on the base and extending upwardly therefrom and spaced from each other and from the bag supply supporting means, each leg having mounted thereon a free-standing hooked end having a bag caming surface, the hooked ends and caming surfaces thereof being adapted to receive a folded down portion of an individual bag and to cause the bag to cam downwardly against the hooked end caming surfaces when the bag is loaded such that the perimeter of the folded down portion returns against the hooked ends under load conditions, wherein the hooked ends are rotatably mounted on the support legs, such that a distance between said hooked ends and said bag supply supporting means may be varied.

2. An apparatus as defined by claim 1, wherein each of the support legs includes a vertical portion and an extension member extending from the vertical portion toward the bag supply supporting means, the hooked ends being mounted on the extension members so that the hooked ends are offset vertically from the vertical portion of their respective legs and are situated closer to the bag supply supporting means than the legs are situated with respect to the bag supply supporting means.

3. An apparatus as defined by claim 1, wherein the bag supply supporting means includes a pair of vertical posts separated from each other and mounted on the base member, at least one horizontal support bar interposed between and joined to the vertical posts, and a clamp member mounted on the support bar, the clamp member including a protrusion extending outwardly therefrom, the protrusion being adapted to be fitted through an opening formed in each bag of the supply of bags for holding the supply of bags in place on the support bar.

* * * * *